US005931406A

United States Patent [19]

Siebert

[11] Patent Number: 5,931,406

[45] Date of Patent: Aug. 3, 1999

[54] METHOD AND WINDER FOR THE CONTINUOUS WINDING OF A MATERIAL WEB

[75] Inventor: Klaus Siebert, Appleton, Wis.

[73] Assignee: Voith Sulzer Papiertechnik Patent GmbH, Germany

[21] Appl. No.: 08/986,940

[22] Filed: Dec. 8, 1997

[51] Int. Cl.[6] ..... B65H 18/16

[52] U.S. Cl. ..... 242/541.4; 242/547

[58] Field of Search ..... 242/541.1, 541.4, 242/541.5, 541.6, 541.7, 547

[56] References Cited

U.S. PATENT DOCUMENTS

| | | | |
|---|---|---|---|
| 3,834,642 | 9/1974 | Kampf | 242/547 |
| 4,491,283 | 1/1985 | Pav et al. | 242/547 |
| 5,249,758 | 10/1993 | Muller et al. | 242/541.5 |
| 5,251,835 | 10/1993 | Kyytsonen | 242/541.1 |
| 5,370,327 | 12/1994 | Adamski | 242/541.6 |
| 5,544,841 | 8/1996 | Didier et al. | 242/541.1 |
| 5,560,566 | 10/1996 | Bagnato | 242/541.1 |
| 5,673,870 | 10/1997 | Fielding et al. | 242/541.1 |
| 5,690,298 | 11/1997 | Ruck | 242/541.6 |
| 5,782,426 | 7/1998 | Kinnunen et al. | 242/541.5 |

FOREIGN PATENT DOCUMENTS

| | | | |
|---|---|---|---|
| 36 27 463 A1 | 2/1988 | Germany | 242/547 |
| 41 16 031 C2 | 2/1995 | Germany . | |
| 44 28 249 A1 | 2/1995 | Germany . | |
| 196 07 349 A1 | 8/1997 | Germany . | |
| 196 35 216 A1 | 3/1998 | Germany . | |
| 197 45 005 A1 | 7/1998 | Germany . | |
| 63-180657 | 7/1988 | Japan | 242/547 |

*Primary Examiner*—John P. Darling
*Attorney, Agent, or Firm*—Ostrolenk, Faber, Gerb & Soffen, LLP

[57] ABSTRACT

A winder is proposed for continuously winding a paper, while forming a wound reel on a spool, having a contact pressure drum, which forms a winding nip with the wound reel and is rotatably arranged on a lifting table, which can be displaced vertically or substantially vertically, and having a guide for the spool, which comprises guide rails arranged parallel or substantially parallel to an imaginary horizontal. On the lifting table is a transport device, on which the contact pressure drum is rotatably arranged, and that the transport device can be displaced horizontally by means of a thrust device. The contact pressure drum moves vertically to establish one nip at a time with each spool in sequence, and to move out of the way of horizontal motion of a spool moving toward its winding position.

29 Claims, 2 Drawing Sheets

E
H
E,H
M

METHOD AND WINDER FOR THE CONTINUOUS WINDING OF A MATERIAL WEB

BACKGROUND OF THE INVENTION

The invention relates to a method of winding a continuous material web, especially paper or board web, onto a spool to form a wound reel and to the transfer of the web to a successive spool and relates to a winder for the continuous winding of a material web, especially paper or board web, and particularly to the movement of a contact pressure drum and a new spool for transferring to the new spool and for winding the web.

A winder of the type addressed here in disclosed in EP 0 697 006 B1, and has a contact pressure drum that is rotatably arranged on a vertically displaceable lifting table. A continuously incoming material web, for example a paper web, is guided over a circumferential region of the contact pressure drum, also referred to as a supporting roll or carrier drum, and wound onto a spool to form a wound reel. During the entire winding process, the contact pressure drum, which is pressed against the circumference of the wound reel and forms a winding nip with the latter, is arranged underneath a horizontal guide path, along which the initially empty spool and, following the severing and transferring of the material web, said spool together with the wound reel wound thereon, is guided. In order to prepare a spool change, the contact pressure drum is moved vertically upward and at the same time the almost finished wound reel, which hitherto has been held in a fixed location in a winding position, is displaced along the guide path in the direction of a finished reel position. During this operation, the line contact between contact pressure drum and the almost finished wound reel is maintained. The contact pressure drum is pressed against the circumference of an empty spool, which is displaced along the guide path out of a waiting position into a winding start position, and forms a second winding nip with said empty spool. The material web is then severed, its free end is wound onto the empty spool and the finished wound reel is displaced horizontally in such a way that the contact between said wound reel and the contact pressure drum is broken. In order to transfer the new wound reel from the winding start position into the winding position, the contact pressure drum is displaced vertically downward and the new wound reel is displaced along the guide path. In the process, the new wound reel rolls over a circumferential region of the contact pressure drum, that is to say that the winding nip is maintained during the transferring of the new wound reel into the winding position, and travels over a circumferential region of the contact pressure drum. After the new wound reel has reached the winding position and is fixed in this position in a fixed location, the increasing wound-reel diameter is compensated for by a vertical downward movement of the contact pressure drum. This means that, during the entire winding process, the contact pressure drum is pressed from below against the circumference of the wound reel and must therefore carry part of the weight of the wound reel. Because of the sagging of the spool with the wound reel wound thereon, the line force in the winding nip is nonuniform over the web width, which reduces the quality of the finished product. Furthermore, fluctuations in the line force may occur while the new wound roll is being transferred from the winding start position into the winding position, that is to say is traveling over the circumferential region of the contact pressure drum. This may also lead to fluctuations in the line force and thus to discontinuities in the winding hardness or, respectively, the winding hardness profile, as a result of which the winding result is also influenced in an undesired way. Furthermore, it has been shown that, as a result of the vertical moving of the contact pressure drum in order to influence the line force, a complicated control system is necessary. Nevertheless, in many cases, the line force cannot be set sufficiently accurately or jumps and fluctuations in the line force, which are brought about for example by an imbalance in the wound reel, cannot be set sufficiently accurately.

SUMMARY OF THE INVENTION

It is therefore the object of the invention to provide a method and a winder which do not have these disadvantages.

In order to achieve this object, a method having the features of the invention is described. This is distinguished by the fact that the continuously incoming material web is guided over a circumferential region of a contact pressure drum, which forms a winding nip with a wound reel that is held rotatably in a winding position. In order to prepare a spool change, the contact pressure drum, which can preferably be displaced vertically, but at least substantially vertically, is moved downward, that is to say it is lowered. The almost finished wound reel is then displaced out of the winding position in the direction of a finished reel position, and an empty spool is moved out of a waiting position in the direction of the winding position, along a guide path that is preferably horizontal but at least substantially horizontal. The contact pressure drum is now lifted, that is to say displaced vertically upward, and a winding nip between contact pressure drum and empty spool is formed by means of a horizontal or substantially horizontal relative movement of the contact pressure drum with respect to the empty spool. The position of the contact pressure drum with respect to the empty spool is selected here in such a way that the winding nip is formed in an imaginary plane that runs horizontally and in which the center of the contact pressure drum is located, or else underneath this plane. Finally, the material web is severed, its free end transferred onto the empty spool and wound up.

During a spool change, the contact pressure drum is therefore displaced into a position in which the empty spool— viewed in the horizontal direction—can pass this position without these coming into contact with each other. Only then is the contact pressure drum lifted and, by means of a horizontal relative movement with respect to the empty spool, pressed against its circumference with a defined force, and a winding nip formed. In this case, the position of the contact pressure drum with respect to the empty spool is selected in such a way that the center—viewed in the vertical direction—is located at least at the same height or above the center of the empty spool. This ensures that the forces acting on the contact pressure drum are only those which are formed by the pressing of the contact pressure drum onto the circumference of the spool and, respectively, the wound reel wound thereon. In other words, during the winding process, no part of the dead weight of the wound reel is carried by the contact pressure drum (as in the prior art). Consequently, the sagging of the wound reel has virtually no influence, but at least a very low influence, on the line force in the winding nip. It is therefore possible to set a uniform line force over the web width, by which means a high winding quality can be achieved. As a result of the position of the winding nip preferably remaining constant—viewed in the vertical direction—during the entire winding process, fluctuations and jumps in the line force such as occur in the known winder—described at the beginning—during the transferring of the new wound reel into the winding position, because of the rolling of the wound reel over a circumferential region of the contact pressure drum, are avoided. Furthermore, compensation of the fluctuations and jumps in the line force or of the line force profile which occur in the winding nip is possible by means of the horizontal relative movement of the contact pressure drum with respect to the wound reel, in particular since the contact pressure drum, which has a relatively high weight, is only displaced and does not need to be lifted or lowered. As a result, the line force can be set sufficiently finely, as a result of which a high winding quality can be achieved.

In an advantageous embodiment of the method, provision is made for the winding nip between contact pressure drum and empty spool to be formed only when the empty spool is arranged in the winding position. Before the winding nip is formed, therefore, the empty spool is transferred from the waiting position into the winding position and held in the latter in a fixed location. In conjunction with the present invention, "fixed location" is to be understood as meaning that rotation of the spool about its longitudinal axis is possible, and translatory movement of the spool is prevented. The control of the displacement movements of the wound reel and of the contact pressure drum from the beginning of the winding process up to the finishing of the wound reel is relatively simple, it being ensured that in each phase of the winding process a defined line force in the winding nip can be set. In a further design variant of the method, the winding nip between contact pressure drum and empty spool is formed during the displacing of the empty spool out of the waiting position into the winding position. As a result, a spool change can be carried out in a very short time, with the result that the number of wound layers which are wound onto the almost finished wound reel while the material web is being guided in a free draw from the contact pressure drum onto said wound reel is low.

In order to achieve said object, a winder for winding a continuously incoming material web, in particular paper or board web, onto a spool to form a wound reel is also proposed. The winder comprises a lifting table, which can preferably be displaced vertically, but at least substantially vertically, on which a preferably driven contact pressure drum is rotatably arranged. Furthermore, provision is made of a guide for the spool, which comprises at least two guide rails arranged at a distance from each other, parallel or substantially parallel to an imaginary horizontal, along which the spool can be moved. The winder is distinguished by the fact that there is provided on the lifting table a transport device, on which the contact pressure drum is rotatably arranged, and that the transport device on the lifting table can be displaced horizontally or substantially horizontally by means of a thrust device. This makes the rapid compensation of fluctuations and jumps in the line force or of the line force profile occurring in the winding nip possible, since the contact pressure drum does not have to be lifted or lowered vertically for this purpose, but needs only to be displaced horizontally.

Particular preference is given to an exemplary embodiment of the winder which is distinguished by the fact that the contact pressure drum is held rotatably on a guide carriage that can be moved on the transport device and can be displaced horizontally or substantially horizontally by means of a pressure-applying device. The vertically movable lifting table is therefore used exclusively to make it possible for an empty spool to pass during a spool change, when being transferred from a waiting position into the winding position. The increase in diameter of the wound reel, which is held in the winding position in a fixed location, is compensated for in the case of this exemplary embodiment by a balancing movement of the contact pressure drum, which is realized by means of a horizontal displacement of the transport device, while at the same time the line force in the winding nip is controlled by means of a relative movement of the contact pressure drum with respect to the wound reel by means of a horizontal displacement of the guide carriage. In order to automate the winding process, the relative movement of the contact pressure drum in order to set the line force can also be regulated with the aid of suitable means.

Further advantageous exemplary embodiments of the winder emerge from the remaining subclaims. The type of drive construction described in claim 18 is disclosed in conjunction with another winder by U.S. Pat. No. 5,251,835.

BRIEF DESCRIPTION OF THE DRAWINGS

The invention will be explained in more detail below with reference to the drawing, in which.

DESCRIPTION OF THE PREFERRED EMBODIMENTS

The winder described below can generally be used for winding a material web. The winder can be arranged at the end of a machine for the production or finishing, for example a coating machine, of a material web, for example a paper web, in order to wind up the finished material web to form a wound reel. However, the winder can also be used to rewind an already finished wound reel, also referred to as a coil.

FIGS. 1*a* to 1*d* each show a side view of an exemplary embodiment of a winder 1, which is used for winding a material web 3, for example a paper or board web, onto a spool. The latter may be formed, for example, by a tubular roll with bearing journals, or by a core which is carried by a winding bar. FIGS. 1*a* to 1*d* reveal a sequence of functional steps of the winder 1.

Figures 1A, 1B, 1C, 1D:
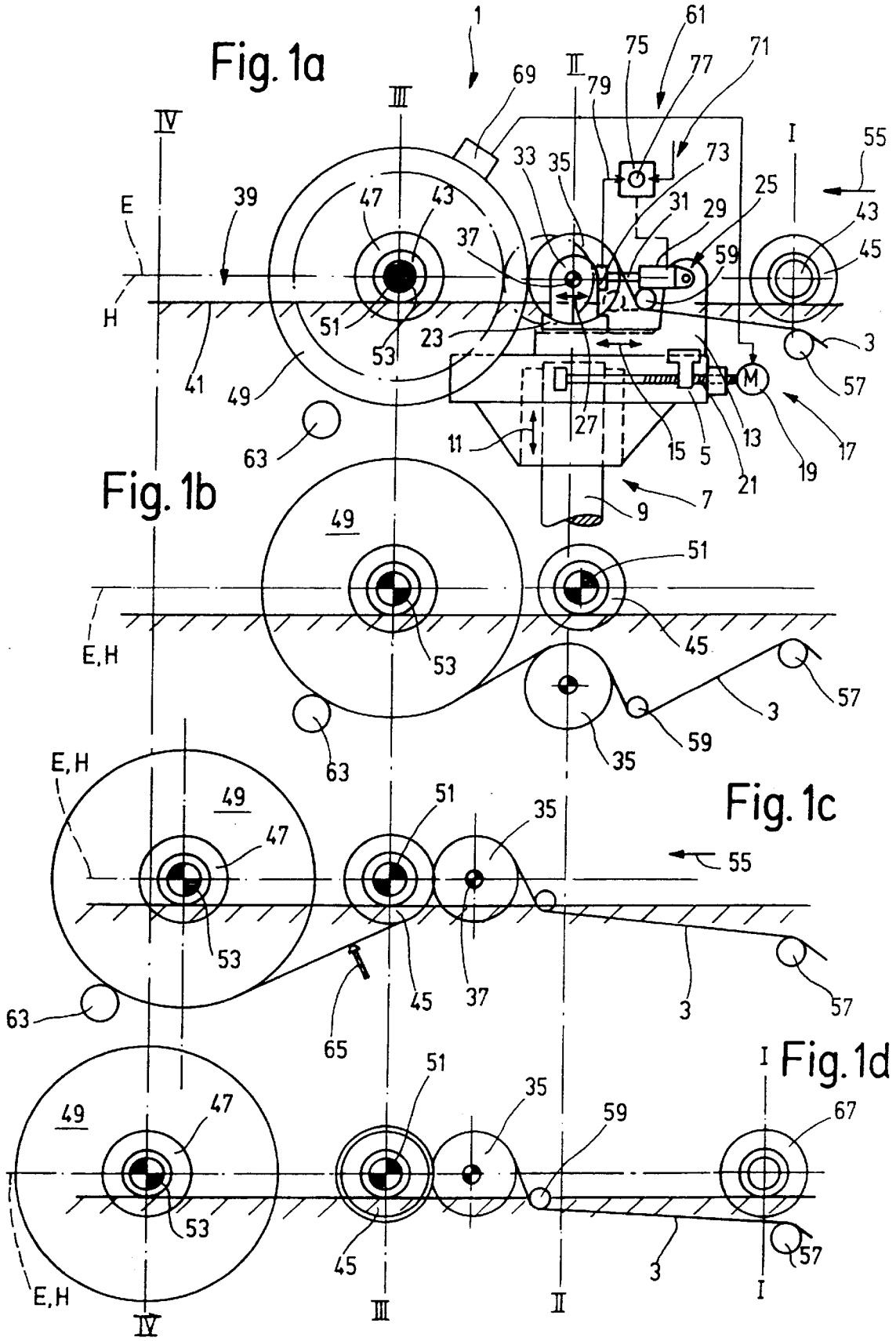
FIGS. 1*a* to 1*d* each show a sketch of the principle of a first exemplary embodiment of the winder according to the invention in various winding phases.

The winder 1 comprises a lifting table 5, which can be displaced vertically in the direction of a double arrow 11 by means of a guide device 7, of which only one guide means 9 is illustrated in FIG. 1*a*. Provided on the lifting table 5 is a transport device 13, also referred to as a carriage, which can be moved in the horizontal direction (double arrow 15) on a guide (not illustrated) which is fitted to the lifting table 5. In order to move the transport device 13 on the lifting table 5, provision is made of a thrust device 17 which, in the case of this exemplary embodiment, is formed by a spindle drive which comprises a threaded spindle 21 driven by a motor 19. The configuration of the thrust device 17 is fundamentally variable and, for example, may also be formed by a piston/cylinder unit—preferably hydraulic. Arranged on the transport device 13 is a guide carriage 23, which can be moved in the horizontal direction (double arrow 27), by means of a pressure-applying device 25, on a second guide (not illustrated) which—at least partly—is fastened to the transport device 13. The pressure-applying device 25 is designed here as a piston/cylinder unit—preferably hydraulic—which comprises a piston (not illustrated) guided in a cylinder 29. Fastened to the piston is a piston rod 31, which is connected at its other end to the guide carriage 23 or to a mounting 33 fastened thereto. The configuration of the pressure-applying device 25 is variable, that is to say that in the case of a different exemplary embodiment of the winder 1, the pressure-applying device 25 may for example be formed by a spindle drive.

Furthermore, provision is also made of a contact pressure drum 35, also referred to as a pressure roll, which is held in a fixed location on the guide carriage 23 by means of the mounting 33. The contact pressure drum 35 is driven by a drive 37, which is illustrated using a symbol and is designed here as a center drive which is arranged in a stationary manner, that is to say in a fixed position on the guide carriage 23. With the aid of the drive 37, an adjustable drive torque can be applied to the contact pressure drum 35.

The winder 1 also comprises a guide 39 for a spool, onto which the material web 3 is wound. The guide 39 comprises at least two guide rails, which are arranged at a distance from each other, parallel to an imaginary horizontal H, and of which in the illustration according to FIGS. 1*a* to 1*d* only the guide rail 41 can be seen. In FIG. 1*a,* an empty spool 45 is located by way of its bearing journals 43 and by means of bearings (not illustrated) on the guide rails 41 of the guide 39. In the winding phase illustrated in FIG. 1*a,* the continuously incoming material web 3 is wound to form a wound reel 49 on a spool 47, which likewise rests by way of its bearing journals 47 on the guide rails 41. Furthermore, in order to guide and hold a spool, provision is made of two (not illustrated) bearing and transport devices, which are known per se and are also referred to as primary and secondary mountings, by means of which a spool can be moved along the guide rails 41 during the winding process. The primary and the secondary mountings may have, for example, a construction similar to that of the guide carriage 23.

Furthermore, provision is made of a first drive 51 and a second drive 53, which are each illustrated by a symbol. In the winding phase illustrated in FIG. 1*a,* both the drives 51, 53, which are arranged on opposite sides of the winder 1, are coupled to the spool 49 that is held in the winding position (III). By means of the drives 51, 53, which are preferably designed as center drives, a defined torque can be applied to the wound reel or to the spool on which the wound reel is being wound. The drives 51, 53 can be displaced independently of each other parallel to the guide rails 41 of the guide 39, that is to say in the horizontal direction, by displacement means that are not illustrated. In a particularly preferred exemplary embodiment of the winder, which is distinguished by a simple construction, one of the drives 51, 53 is in each case held in a stationary manner on one of the bearing and transport devices.

The wound reel 49, which in FIGS. 1*a* and 1*b* is held in a winding position (III) in a fixed location, forms a winding nip with the contact pressure drum 35 over part of whose circumference the material web 3 is guided, in the case of this exemplary embodiment said winding nip being located during the entire winding process in an imaginary plane E that runs horizontally and is illustrated by a dash-dotted line. The centers of the contact pressure drum 35, which is located in a lifted position, and of the spools 45, 47 that are resting on the guide rails 41 are located in the plane E, which covers an area perpendicular to the drawing plane of FIG. 1*a*.

As can be seen from FIG. 1*a,* the material web 3 is guided from the production or processing machine arranged upstream of the winder I—viewed in the running direction of the material web 3 (arrow 55)—firstly over a turn roll 57 arranged in a stationary manner inside the winder 1, and from said turn roll 57 to a turn roll 59 which is fastened to the guide carriage 23 and is constructed, for example, as a stretch roll. From the turn roll 59, the material web 3 is fed to the contact pressure drum 35, led over a circumferential region of about 180° of the contact pressure drum 35 and wound onto the wound reel 49. By means of the pressure-applying device 25, the contact pressure drum 35 is pressed against the circumference of the wound reel 49 with a defined force, so that a winding nip is formed, through which the material web 3 is guided. The line force, also referred to as clamping pressure or clamping force, in the winding nip is controlled by moving the guide carriage 23, on which the contact pressure drum 35 is held in a fixed location, on the transport device 13. In a different exemplary embodiment of the winder 1, provision is made for the line force in the winding nip being regulated, that is to say the line force is set automatically to a desired value with the aid of a controller. Provided for this is a control unit 61—illustrated only schematically in FIG. 1*a*—which will be discussed in more detail below. In both cases, that is to say in the case of controlling or regulating the line force, the pressure-applying device 25, which is associated with the guide carriage 23 carrying the contact pressure drum 35, is influenced in a defined way. By means of displacing the contact-pressure drum 35, fluctuations in the line force can be compensated for or avoided, with the result that a desired winding hardness can be achieved continuously. The increase in diameter of the wound reel 49—while the wound reel 49 is held in a fixed location in the winding position (III)—is compensated for by moving the transport device 13 on the lifting table 5 in a direction opposite to the web running direction (arrow 55), that is to say to the right in the case of the exemplary embodiment of the winder that is illustrated in FIGS. 1*a* to 1*d*.

Arranged underneath the wound reel 49 that is located in the winding position (III) is a pinch roll 63, also referred to as pressure roll, which extends over the entire width of the wound reel 49, can be displaced by means of a guide device that is not illustrated, and can be pressed against the circumference of the wound reel 49 that forms a winding nip with the contact pressure drum 35. The pinch roll 63 serves the purpose of preventing air from being dragged between the winding layers of the wound reel 49, for example when the material web 3 is being guided in a free draw. The pressure force with which the pinch roll 63 is pressed against the circumference of the wound reel 49 is adjustable. The pinch roll 63 may be driven by a drive, for example a center drive.

The function of the winder 1 is to be explained in more detail below with reference to a winding process. For reasons of clarity, those parts of the winder 1 which were described using FIG. 1*a* and by means of which the contact pressure drum 35 can be displaced are not illustrated in FIGS. 1*b* to 1*d*. The material web 3 is guided over the contact pressure drum 35 and wound onto the wound reel 49 that is held in a fixed location in the winding position (III) (FIG. 1*a*). Before the wound reel 49 reaches its final/intended diameter, the pinch roll 63 is pressed against the circumference of the wound reel 49. After this the contact pressure drum 35 is moved vertically downward into the lowered position in illustrated in FIG. 1*b,* in which the material web 3 is guided in a free draw from the contact pressure drum 35 to the wound reel 49. In addition, the empty spool 45 is moved out of the waiting position (I) illustrated in FIG. 1*a* in the direction of the winding position (III), in which the wound reel 49 is still located. Before the empty spool 45 is moved in the direction of the winding position (III), or while it is being moved, the first drive 51 is coupled to the empty spool 45 and the latter is accelerated to the running speed of the material web 3. Before the empty spool 45, traveling in the direction of the arrow 55, has traveled over the position (II), that is to say has passed the contact pressure drum 35, above the latter, the almost finished wound reel 49 is displaced in the direction of a finished reel position (IV), so that the winding position (III) is free, and the empty spool 45 can be held therein in a fixed location using suitable means.

The contact pressure drum 35 is then displaced vertically upward into the lifted position illustrated in FIG. 1*c,* in which the center of the contact pressure drum 35 is located on the imaginary plane E. The winding nip between contact pressure drum 35 and empty spool 45 is formed by a horizontal relative movement of the contact pressure drum 35 in the direction of the arrow 55, said movement being realized by moving the transport device 13 and/or the guide carriage 23. This winding phase is illustrated in FIG. 1*c*. The material web 3, which is guided from the contact pressure drum 35, over a circumferential region of the empty spool 45 and from the latter in a free draw to the wound reel 49, is severed in the region of the free web draw by means of a severing device that is known per se and indicated by an arrow 65 and which, for example, may be formed by an air-blast jet, and its free end is wound onto the spool 45 (FIG. 1*d*). The increase in diameter of the wound reel wound on the spool 45 that is held in a fixed location in the winding position (III)—not illustrated—is compensated for by moving the transport device 13 to the right—as described with reference to FIG. 1*a*—in a direction opposite to the running direction of the material web (arrow 55), and the line force in the winding nip is controlled, if appropriate regulated, by moving the guide carriage 23 in the direction of the double arrow 27.

The full wound reel 49, after reaching the finished reel position (IV) as illustrated in FIG. 1*d,* is braked to a standstill by the second drive 53. The second drive 53 is then detached from the wound reel 49, guided to the spool 45 that is held in the winding position (III) in a fixed location and is being driven by the first drive 51, and coupled to said spool. The first drive 51 is then detached from the spool 45. For a brief time, therefore, both the drives 51, 53 are effectively connected to the spool 45. This completes the spool change. As illustrated in 1*d,* an empty spool 67 is introduced into the waiting position (I) in order to prepare the subsequent spool change.

In the case of the winder 1 described with reference to FIGS. 1*a* to 1*d,* the drives 51, 53 are coupled alternately, that is to say one after the other, to a wound reel or to the spool on which the wound reel is wound, in order to apply thereto a defined drive or braking moment. According to a further design variant—not illustrated—provision is made for one of the drives 51, 53 in each case to be assigned to a wound reel or a spool during the entire winding process. By this means, discontinuities in the line force and thus in the winding hardness or the winding hardness profile, which could possibly occur during the changing of the drive—as described with reference to FIGS. 1*a* to 1*d*—are avoided in an advantageous way. In the case of this exemplary embodiment, therefore, only one of the two bearing and transport devices is also assigned to a spool, and guides the latter from the waiting position (I) as far as the finished reel position (IV). The next spool is then guided by the other of the bearing and transport devices.

Figure 2:
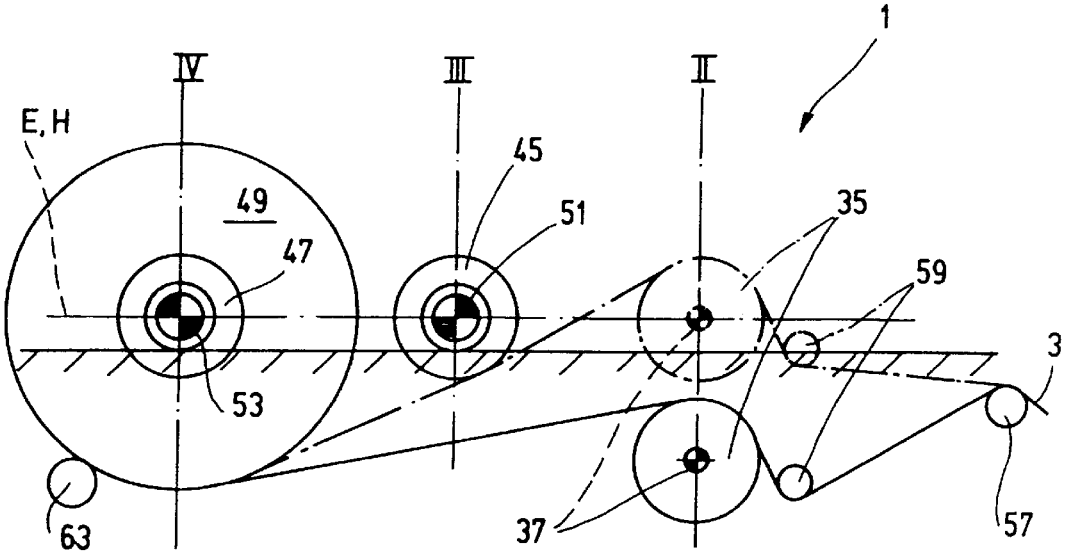
FIG. 2 shows a sketch of the principle of the winder according to FIGS. 1*a* to 1*d,* which operates in accordance with a further design variant of the method according to the invention and FIGS. 3*a* and 3*b* each show a sketch of the principle of the winder operating in accordance with a third design variant of the method, in various functional positions.

FIG. 2 shows the winder 1 that was described with reference to FIGS. 1*a* to 1*d* and in which the spool change is carried out in accordance with a different design variant. This is distinguished by the fact that the contact pressure drum 35 is only moved vertically upward out of its lowered position, illustrated in FIG. 2 with a continuous line, into its lifted position, illustrated in FIG. 2 with a dashed line, when the empty spool 45, moving in the direction of the winding position (III), has already passed this position and reached the winding position (III) and is held in this position in a fixed location. As a result of this measure, and as a result of the defined distance of the winding position (III) from the position (II), it is ensured that, after the contact pressure drum 35 has reached its lifted position, the material web 3 initially only touches the circumference of the empty spool 45 (driven by the first drive 51) or wraps around it only slightly. The circumferential region of the empty spool 45 over which the material web 3 is guided can then be enlarged in a defined way by moving the contact pressure drum 35 in the direction of the spool 45 that is held in the winding position (III). What is advantageous here is that using a relatively simple control system, the forces acting on the material web when the material web 3 is being laid onto the circumference of the spool 45, that is to say during an enlargement of the wrap angle, can be kept small. The above-mentioned position (II) is preferably a starting position for the contact pressure drum 35, in which position the latter is moved vertically by means of the lifting table 5.

Figure 3A:
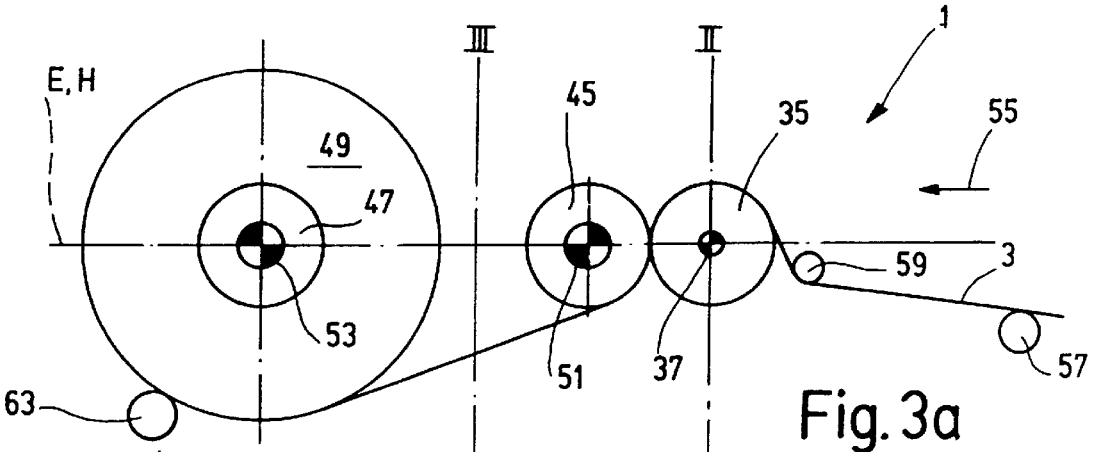
Figure 3B:
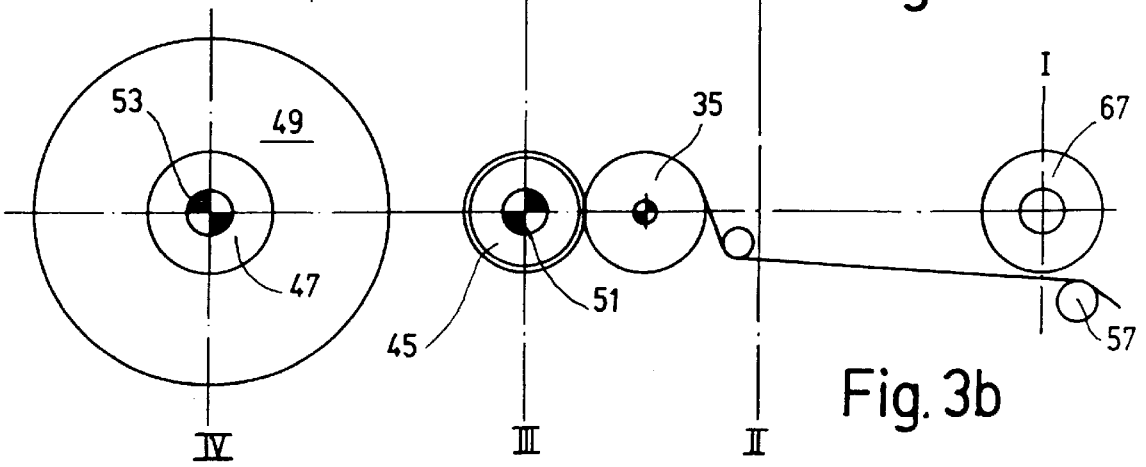

A third design variant of the winding method using the winder 1 described with reference to FIGS. 1*a* to 1*d* is explained in more detail below with reference to FIGS. 3*a* and 3*b*. The empty spool 45 is displaced out of the waiting position (I) into the position illustrated in FIG. 3*a* and held, this position being located between the initial position (II) of the contact pressure drum 35 and the winding position (III). The contact pressure drum 35 is then moved vertically upward by means of the lifting table 5, until its center is located in the plane E. By moving the contact pressure drum 35 horizontally by means of the transport device 13 and/or of the guide carriage 23, in the direction of the arrow 55, that is to say to the left of FIG. 3*a,* the winding nip with the empty spool 45 is formed. The empty spool 45 and the contact pressure drum 35 are then moved together in the direction of the arrow 55, until the empty spool 45 has reached the winding position (III). The material web can then be transferred to the empty spool 45—as described with reference to FIGS. 1*c* and 1*d*.

The method discussed above and having the features described above readily emerges from the description relating to FIGS. 1*a* to 3*b*. This method is distinguished in particular by the fact that the vertical position of the winding nip is preferably located in the horizontal plane E during the entire winding operation, and that the center of the contact pressure drum lies in the plane E or above it. Furthermore, at least during the winding process, the spool with the wound reel wound thereon is displaced only along a horizontal guide path which is defined by the arrangement of the guide rails 31 of the guide 39.

In the case of the winder 1 explained with reference to FIGS. 1*a* to 1*d,* the contact pressure drum 35 can be displaced vertically along a straight line. It is of course also possible to move said drum along an inclined plane having a rising course, or to realize the vertical displacement of the contact pressure drum 35 by pivoting the contact pressure drum or the lifting table 5. What is important is that the contact pressure drum is displaceable in the vertical direction, so that it can be moved out of the horizontal guide path of the spool and moved back into this path once more. This ensures that the spool can pass the contact pressure drum horizontally and can be displaced into the winding position, without these two coming into contact.

For the purpose of controlling the winder 1, provision is made of the control unit that is illustrated in very schematic form in FIG. 1*a,* and which controls the motor 19 of the threaded spindle 21 of the thrust device 17 as a function of the rate of growth of the diameter of the wound reel 49. The growth in the diameter of the wound reel 49 is measured by means of a measuring device 69. The horizontal position of the transport device 13 is therefore preferably changed on its own, that is to say exclusively in accordance with the increase in the wound reel diameter. The magnitude of the line force in the winding nip formed between the contact pressure drum 35 and the wound reel 49 is preferably determined on its own, that is to say exclusively, by moving the guide carriage 23 holding the contact pressure drum 35, preferably being regulated by means of a regulating device 71. The latter comprises a measuring device 73 for the line force, a controller 75, a setpoint generator 77 and a control unit/device that is not illustrated. The measuring device 73 is connected to the controller 75 via a measuring line 79, or opens into the latter. The setpoint generator 77 specifies the desired setpoint to the controller 75.

In the event that the value of the line force in the winding nip, which is measured by the measuring device 73, deviates from the setpoint prescribed by the setpoint generator 77, the controller 75 outputs a signal to the control unit/device. This then alters the pressure in the cylinder 29 of the pressure-applying device 25, in such a way that the measured value of the line force approaches the setpoint. By this means, the line force can be kept to a value, for example a constant value, even if a disturbance occurs in the winding process. A disturbance may be, for example, imprecise movement of the transport device 13, with the result that the position of the winding nip formed by the contact pressure drum 35 and the wound reel 49 is slightly displaced.

In the case of a further exemplary embodiment—not illustrated—of the winder 1, provision is made for the contact pressure drum 35 to be held in a fixed location, that is to say rotatably directly on the transport device 13. By moving the contact pressure drum 35 horizontally with the aid of the transport device 13, the line force in the winding nip is controlled/regulated here, and as a result compensation for the increasing wound reel diameter is carried out. In other words, in order to set the line force to a desired value, the transport device 13 is moved horizontally in the direction opposite to the running direction of the material web 3, that is to say to the right in FIGS. 1*a* to 3*b,* the line force being controlled/regulated by influencing the movement process. The fact that in this exemplary embodiment the guide carriage 23 can be omitted means that the construction of the winder 1 is simplified.

In summary, it should be emphasized that as a result of the fact that the line force in the winding nip is set or regulated during the entire winding process by means of horizontal displacement of the contact pressure drum, precise control of the winding hardness is possible from the start of the winding process until its end, by which means a good winding result can be achieved.

I claim:

1. A method of winding a continuous material web onto a sequence of a first spool and a second spool to form respective first and second wound web reels on the spools, the method comprising:

guiding the material web over a circumferential region of a contact pressure drum which region is less than the entire circumference of the contact pressure drum, then guiding the web through a first winding nip between the contact pressure drum and the first wound web reel on the first spool for winding the web on the first wound web reel, the first wound web reel being at a winding position;

when the first wound web reel is almost fully wound, lowering the contact pressure drum away from the first wound web reel to open the first nip and out of a path movement of the empty second spool toward the winding position, wherein the contact pressure drum in an unlowered position would interfere with the movement of the second spool toward the winding position of the first reel but in the lowered position would not interfere with that movement;

displacing the empty second spool out of a waiting position thereof and in the direction toward the winding position along a horizontal path, wherein the second spool remains out of contact with the contact pressure drum as the second spool passes the contact pressure drum while the second spool is moving toward the winding position;

raising the lowered contact pressure drum and forming a second winding nip between the contact pressure drum and the second spool and also with the second wound web reel being wound on the second spool by moving the contact pressure drum substantially horizontally relative to the empty second spool to form the second winding nip, wherein the second winding nip is formed in an imaginary plane that runs substantially horizontally; and severing the material web and thereafter winding the free end of the material web onto the empty second spool for starting the second wound reel.

2. The method of claim 1, wherein as the second winding nip is formed, the contact pressure drum is located so that the center of the contact pressure drum is located in or below the imaginary plane.

3. The method of claim 1, further comprising displacing the almost fully wound first wound web reel out of the winding position and toward a finished reel position after the contact pressure drum has been lowered for enabling the empty second spool to be moved toward the winding position of the previously displaced first wound web reel.

4. The method of claim 3, wherein the second spool is moved to the winding position and the contact pressure drum is moved relatively to the second spool to define the second winding nip at the winding position.

5. The method of claim 1, wherein the second spool has a respective second winding position and the contact pressure drum is moved relatively to the second spool for defining the second winding nip between the contact pressure drum and the second spool when the second spool has reached the respective second winding position.

6. The method of claim 1, wherein the contact pressure drum and the second spool are so moved during displacement of the second spool out of the waiting position and toward the winding position that the contact pressure drum forms the second winding nip with the second spool during the displacement of the second spool.

7. The method of claim 1, further comprising controlling and regulating the line force in the winding nips between the contact pressure drum and the wound web reels.

8. The method of claim 1, further comprising compensating for increasing wound reel diameter of the wound web reels by moving the contact pressure drum in a balancing manner.

9. The method of claim 8, further comprising controlling and regulating the line force in the winding nips between the contact pressure drum and the wound web reels; the compensating movement in a balancing manner of the contact pressure drum being superimposed on the relative movement of the contact pressure drum and the wound web reels for controlling and regulating the line force in the winding nip.

10. The method of claim 8, wherein the compensating movement of the contact pressure drum and the relative movement of the contact pressure drum and the wound web reels controlling the line force are performed through substantially horizontal movement.

11. The method of claim 1, further comprising driving the first and second spools as the first and second reels are being wound during their entire respective winding processes.

12. The method of claim 1, further comprising driving the contact pressure drum to rotate correspondingly to the respective reel then being wound at the respective first and second nips.

13. The method of claim 1, further comprising selectively applying a pinch roll and pressing against the circumference of the wound reel then in the winding position.

14. The method of claim 1, further comprising forming a free material web draw between the contact pressure drum and the almost finished first wound reel as a result of and during lowering the contact pressure drum.

15. A method of winding a continuous material web onto a sequence of a first spool and a second spool to form respective first and second wound web reels on the spools, the method comprising:

guiding the material web over a circumferential region of a contact pressure drum which region is less than the entire circumference of the contact pressure drum, then guiding the web through a first winding nip between the contact pressure drum and the first wound web reel on the first spool for winding the web on the first wound web reel, the first wound web reel being at a winding position;

when the first wound web reel is almost fully wound, moving the contact pressure drum vertically out of a plane joining the axis of the almost fully wound first web reel and the axis of the second spool on which the second reel is to be wound for providing a path for the second reel to move toward the winding position past the contact pressure drum without interference by the contact pressure drum with movement of the second spool to the winding position, wherein the contact pressure drum in the position not out of the plane would interfere with the movement of the second spool toward the location of the first reel, but in the position out of the plane the contact pressure drum would not interfere with that movement;

displacing the empty second spool out of a waiting position thereof and in the direction toward the winding position, wherein the second spool remains out of contact with the contact pressure drum as the second spool passes the contact pressure drum while the second spool is moving toward the winding position;

moving the contact pressure drum vertically and forming a second winding nip between the contact pressure drum and the spool and also with the second wound reel being wound on the second spool by moving the contact pressure drum relative to the second empty spool to form the second winding nip, wherein the second winding nip is formed in an imaginary plane that runs substantially horizontally; and severing the material web and thereafter winding the free end of the material web onto the empty second spool for starting the second wound reel.

16. The method of claim 15, wherein as the second winding nip is formed, the contact pressure drum is located so that the center of the contact pressure drum is located in or below the imaginary plane.

17. A winder for continuously winding a material web on a first spool and thereafter on a second spool, the winder comprising a first spool supported at a first winding position on which the web is first to be wound into a first reel;

a second spool spaced from the first spool on which the web is to be subsequently wound into a second reel after the web is wound on the first spool;

a contact pressure drum positionable for forming a first winding nip with the first reel for pressing on the first reel as the first reel is wound on the first spool; means supporting the contact pressure drum for displacement in a generally vertical direction between the position at which the contact pressure drum can form a winding nip with the first reel and a vertically displaced position out of the pathway between the first reel and the second spool for opening the first nip and for not interfering with the movement of the second spool past the contact pressure drum, which is then in the vertically displaced position, and toward the first winding position;

a guide for guiding movement of the second spool toward the first spool and past the contact pressure drum while the drum is then in the vertically displaced position and without the second spool movement being interfered with by the contact pressure drum; the contact pressure drum being movable into contact with the second pressure drum while the first reel is out of the winding position for forming a second nip between the second spool and the contact pressure drum while the first nip is opened;

a transport device, the contact pressure drum being rotatably supported on the transport device, means for moving the transport device for moving the contact pressure drum to form a respective winding nip with only one of the reels at a respective winding position thereof and for moving the drum so that the contact pressure drum stays in contact with and forms the respective winding nip with the one reel as the reel diameter increases.

18. The winder of claim 17, wherein the contact pressure drum support means comprises a vertical lifting table at the transport device and on which the contact pressure drum is supported for vertical movement out of and into the pathway of guided movement of the second spool.

19. The winder of claim 17, wherein the guide for the second spool is arranged for guiding the second spool to move substantially horizontally toward a respective winding position past the contact pressure drum.

20. The winder of claim 19, wherein the guide for the second spool comprises a substantially horizontally oriented guide rail on which the second spool is supported for substantially horizontal movement.

21. The winder of claim 19, further comprising a thrust device connected with the transport device for moving the transport device substantially horizontally.

22. The winder of claim 17, further comprising a guide carriage supported on the transport device for being displaceables substantially horizontally with respect to the transport device, the contact pressure drum being supported on the carriage, and a pressure applying device for displacing the guide carriage and the contact pressure drum thereon with respect to the transport device.

23. The winder of claim 17, further comprising a controller or regulator for influencing the line force in the winding nip by enabling adjustment of the position of the contact pressure drum with respect to the reel being wound which reel is in contact with the contact pressure drum.

24. The winder of claim 17, further comprising a drive for applying a torque to rotate the contact pressure drum.

25. The winder of claim 17, further comprising a first drive for applying a torque to the first reel being wound on the first spool.

26. The winder of claim 25, wherein there are first and second ones of the torque applying drives which are selectively attachable to the drive of the first spool.

27. The winder of claim 25, further comprising a second drive for applying a torque to the second reel being wound on the second spool.

28. The winder of claim 17, further comprising a pinch roll movable against the circumference of the wound reel being wound on the first spool.

29. The winder of claim 17, wherein the first spool and the contact pressure drum are so located and the guide for the contact pressure drum is so oriented that during the entire winding process with the contact pressure drum forming a winding nip with the first reel, the winding nip remains located in a substantially horizontal plane.

* * * * *